United States Patent [19]

Kish

[11] 4,029,537

[45] June 14, 1977

[54] LABEL APPLICATOR

[75] Inventor: Richard E. Kish, Fairfield, Conn.

[73] Assignee: Pitney-Bowes, Inc., Stamford, Conn.

[22] Filed: Dec. 8, 1975

[21] Appl. No.: 638,552

[52] U.S. Cl. ..... 156/497; 156/521; 156/568; 156/571; 156/DIG. 31; 156/DIG. 33; 271/196; 271/276

[51] Int. Cl.[2] ..... B65C 9/14; B65C 9/18

[58] Field of Search ..... 156/497, 519, 521, 552, 156/566, 567, 568, 571, DIG. 28, DIG. 31, DIG. 33; 271/95, 96, 196, 276, 112

[56] References Cited

UNITED STATES PATENTS

| | | | |
|---|---|---|---|
| 3,533,618 | 10/1970 | Carstens | 271/276 |
| 3,545,746 | 12/1970 | Ledger et al. | 271/276 |
| 3,684,627 | 8/1972 | Hottendorf | 156/566 X |
| 3,845,951 | 11/1974 | Hamaker | 271/196 X |

*Primary Examiner*—William A. Powell
*Assistant Examiner*—M. G. Wityshyn
*Attorney, Agent, or Firm*—Albert W. Scribner; William D. Soltow, Jr.; Peter Vrahotes

[57] ABSTRACT

In a label applicating apparatus a self-contained vacuum generating means is incorporated in the applicator drum so that a partial vacuum may be established at a predetermined peripheral portion of the drum in response to the rotation of said drum. The generated partial vacuum is maintained for a predetermined portion of each cyclically rotary movement of the drum.

3 Claims, 6 Drawing Figures

FIG. 1
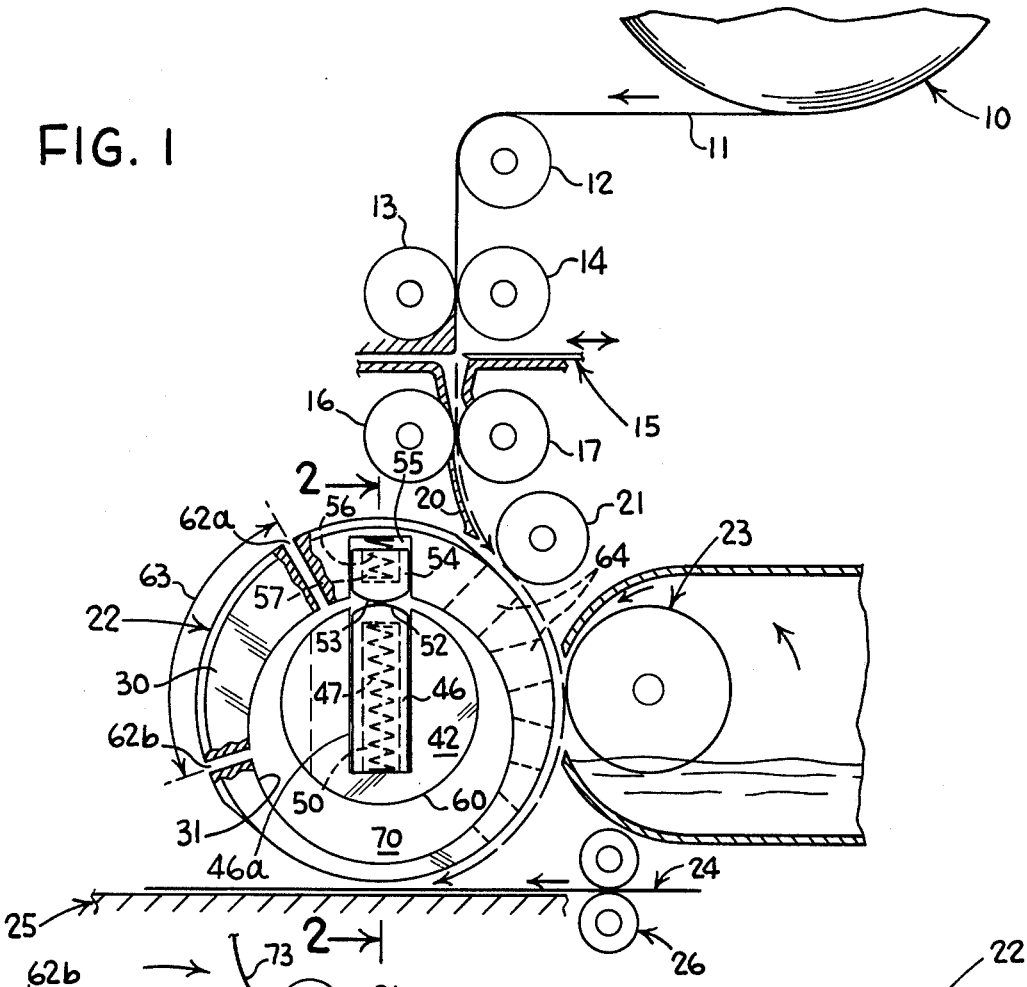
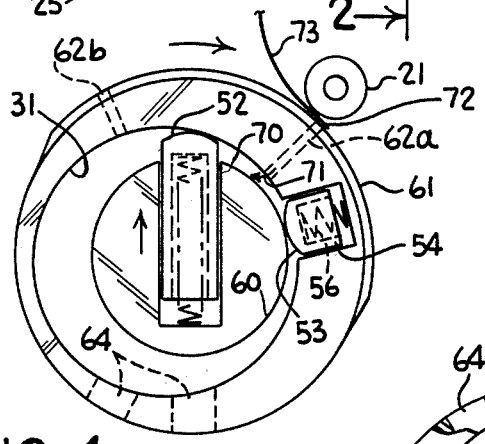
FIG. 4
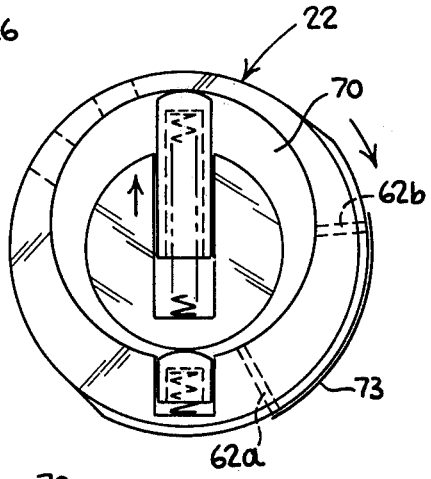
FIG. 5
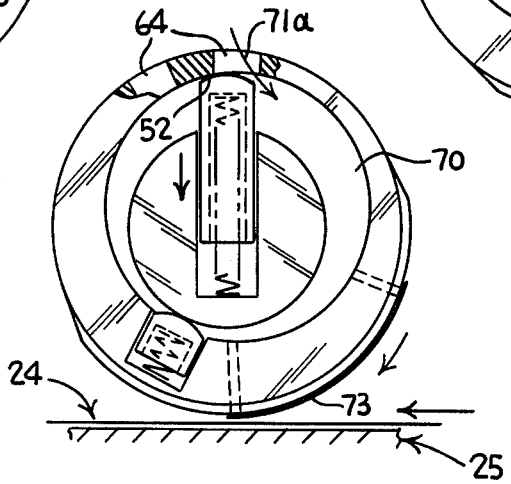
FIG. 6

LABEL APPLICATOR

BACKGROUND OF THE INVENTION

In many Conventional type label applicator machines, a label is delivered to a first position where it is deposited on the periphery of an applicator drum. The drum is then rotated so as to arcuately transport the label to a second position where the label may be deposited on a label receiving document such as an envelope, record car, or the like. While the label is being moved from said first to said second positon, it is in many cases retained on the drum periphery by means of a partial vacuum. This partial vacuum has heretofore been generated by the means of an external air pumping arrangement that is coupled through suitable connecting tubes and valves to the drum surfaces. These conventional vacuum systems, while producing the desired results, have not always been satisfactory due to the cumbersome nature of all the external air pumping harness and valving required and the associated means for operatively coupling such to the rotating applicator drum.

SUMMARY OF THE INVENTION

This invention contemplates the provision of a radial vane type air pumping means in conjuction with a label applicator drum whereby rotation of the drum will operate said pumping means and establish for a predetermined period a partial vacuum at suitable holes formed through the cylindrical walls of a label retaining portion of the drum periphery. It is the primary object of this invention to provide a simple, self-contained and highly reliable vacuum generating device that is incorporated in a label applicator drum, and one that will automatically operate in predetermined timed relation with respect to the rotation of the drum.

Other objects of the invention will become apparent as the disclosure progresses.

In the drawings:

FIG. 1 is an elevational view taken in partial section along section line 1—1 of FIG. 2, and illustrates the structural environment in which the instant invention is embodied.

FIGS. 4, 5 and 6 are fragmentary views illustrating the various operative positions of the drum and associated vacuum generating means.

DETAILED DESCRIPTION OF THE INVENTION

Figure 2:
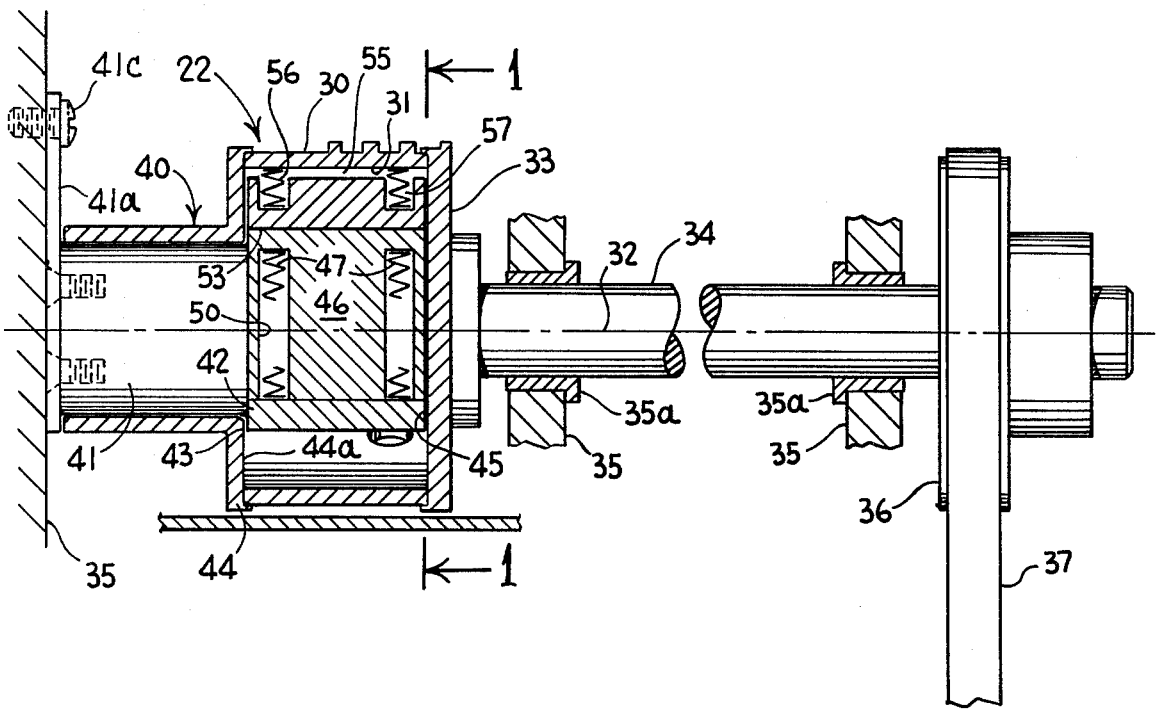
FIG. 2 is a cross-sectional view taken along section line 2—2 of FIG. 1.

Referring to FIGS. 1 and 2, the structural environment for the instant invention will be described first; this apparatus being of a conventional nature and thus being described only in a general way. A rotatably supported tape roll 10 is adapted to pay out tape 11 on one side of which successive imprints have been made; the tape 11 thus comprising an intergral series of labels. The tape after passing over guide roll 12 extends between and is driven by a set of cooperating feed rolls 13 and 14 preparatory to moving past a reciprocable label cutting knife 15 and through a second set of drive rolls 16 and 17. Beneath the rolls 16, 17 there is provided a stationary arcuate label guide plate 20 and an idler roll 21 that peripherally cooperates with the label applicator drum 22. Each successive label cut from tape 11 by the knife 15 and delivered to a first position between the drum 22 and roll 21 is adapted to be retained by a partial vacuum existing at the outer cylindrical periphery of the drum so as to be arcuately transported by the drum past a suitable label moistening means 23 to a second position from which they may be progressively rolled or pressed onto the upper surface of an envelope 24 or other document that is moved along the planar support member 25 and passed the lower side of the drum 22 by suitable feed roll means 26. The apparatus and its supporting means described thus far may be conventional in nature and hence need not be discussed in further detail here.

In prior label applying devices air pumping means have been used for producing a label retaining vacuum at the drum periphery, and such in most cases have comprised a standard type air pump together with air lines, couplings, valves, valve controls etc. that are interconnected and disposed externally of the labe applicator drum of the machine. This type of arrangement while producing the desired vacuum function has tended to be cumbersome, and the present invention contemplates the provision within the drum 22 of a vacuum producing arrangement that is relatively simple, self-contained and is both operative and timed in response to the rotation of the drum. The constuction and operation of the drum and its internal air pumping means will not be described in detail.

Referring to FIGS. 1 and 2, the drum 22 comprises a tubular type member 30 which is provided with an outer configuration that is substantially cylindrical and an inner cylindrical recess having cylindrical wall surfaces 31 whose axis is eccentrically disposed with repect to the axis 32, FIG. 2, of the drum, i.e. to the axis of the generally cylindrical drum member 30. Secured to one end of the tubular member 30 is an end plate or disc 33 to which is fixedly attached a drive shaft 34 that is rotatably mounted on the machine frame 35 by any suitable bearing means indicated at 35*a*. Secured to the outer end of shaft 34 is a pulley 36 that is adapted to be driven by an associated belt 37. Removably secured by any suitable means to the other end of the tubular member 30 is flanged tubular hub 40, the latter being rotatably mounted on a stationary shaft 41 that is fixedly secured at its left hand end (as seen in FIG. 2) to the said machine frame 35. This securing means includes a plate 41*a*, FIGS. 2 and 3, that is secured at its lower end by suitable screws to the end of said shaft 41. The upper end of plate 41*a* is formed with an arcuate clamping screw 41*c* that threadedly engages the machine frame 35 whereby the shaft 41 may adjustably rotatably indexed about the said axis 32 so as to initially set the rotatable phase of the non-rotating shaft 41 with respect to the drum 22. As may be seen from FIGS. 1 and 2, the drum 22 is capable of being rotatably driven on the shaft 41 by means of the said drive shaft 34.

The cylindrical head or end portion 42 of stationary shaft 41 is slightly enlarged so as to form a radial shoulder 43 as is shown in FIG. 2; the element s 41, 42, 30 and 34 all having a common axis 32. The axial length of the stationary cylindrical head 42 is such as to provide a close sliding and sealing fit between the said shoulders 43 and the adjacent radial surfaces of the flange 44 of hub 40, and between the end 45 of head 42 and the adjacent inner radial surface of disc 33. the head 42 is formed with a radially extending slot 46*a* in which is slidably disposed a flat plate or blade 46, FIGS. 1 and 2, that is yieldably biased outwardly by means of sitable compression spring means 47 seated between the radial bottom of said slot and the bottoms of recess holes 50 formed in said blade 46. Blade 46 is dimensioned so as to slidably and sealingly engage the surfaces of said slot and the inner surfaces 44*a* of said flange 44 and the corresponding inner surface of disc 33. In that the shaft head 42 is stationary, the blade 46 will always be biased vertically upwardly as seen in FIG. 1 and when the drum 22, which effectively surrounds said stationary head 42 and blade 46, is rotated in a clockwise direction as seen in FIG. 1, the outer tip 52, FIG. 1, of the blade will slidably engage the said inner cylindrical surface 31 of tubular member 30, surface 31 effectively defining a cylindrical recess or chamber whose axis is eccentric with respect ot the said drum axis 32.

When the drum 22 is in its home position, as illustrated in FIG. 1, the outer tips 52 of blade 46 contacts the tip 53 of a corresponding blade 54 that is disposed in a radially extending slot 55 formed in the wall of the tubular member 30. The blade 54 is yieldably biased towards said axis 32 by means of another similar compression spring means 56 seated between the radial bottom of said slot 55 and the bottoms of the spring receiving recesses 57, FIG. 2, formed in said blade 54. The blade 54, similar to blade 46, is dimensioned so as to have a close sliding and sealing fit with respect to the walls forming said slot 55 and the said inner walls of said flange 44 and disc 33 respectively. When the drum 22 is rotated in a clockwise direction, as seen in FIG. 1, the inner tip 53 of blade 54 will ride off the tip 52 of blade 46 and will slidably and sealingly engage the cylindrical outer walls 60, FIG. 1, of said shaft head 42.

Figure 3:
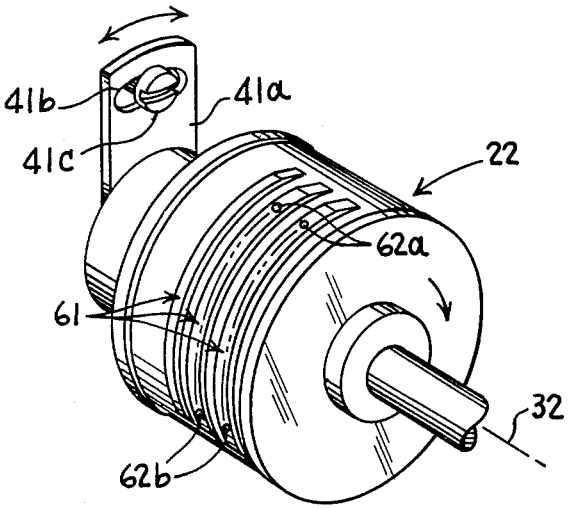
FIG. 3 is a fragmentary perspective view illustrating the external configuration of the label applicator drum.

Referring now to FIG. 3 the drum 22 is formed with three narrow circumferentially extending flanges or ridges 61, the latter reaching nearly halfway around the periphery of the drum. Each ridge is formed with at least two small peripherally spaced vacuum holes 62*a* and 62*b* which extend through the drum walls, i.e. from the outer cylindrical surfaces of said ridges to the inner surface 31 of the tubular member 30 as is best seen in FIG. 1. The holes 62*a* and 62*b* are spaced a distance over a drum peripheral distance corresponding to an arc 63 as indicated in FIG. 1. The said walls of the drum 22 are also formed with larger air vent holes 64 that are collectively located generally diametrical opposite from the peripheral region of the small vacuum holes 62*a* and 62*b*.

The pumping action produced by rotation of the drum 22 will now be described with particular reference to FIGS. 4–6. When the drum is rotated in a clockwise direction from the home position as seen in FIGS. 1 and 4, the blade tip 52 will be slidably engaged by the moving cylindrical surface 31 and the moving blade tip 53 will slidably engage the said cylindrical surface 60. Thus the progressively enlarging chamber 70, FIG. 4, that is behind or trailing the blade 54 will cause a partial vacuum to be increasingly established therein. This action will cause air to flow into this chamber, as indicated by arrows 71 of FIG. 4, though not normally sufficient air flow to eliminate said partial vacuum. As the drum moves to its FIGS. 5 and 6 positions the chamber 70 continues to enlarge thus continuing the development of the partial vacuum in said holes 62*a* and 62*b*. Finally, as indicated in FIG. 6, the initial enlarged vent hole 64 passes the blade tip 52 thus allowing a large in flow of air in chamber 70 as indicated by arrow 71*a* , FIG. 6, and the restoration of ambient pressure in said chamber. As the drum continues to rotate from its FIG. 6 position back to its FIG. 1 home position the chamber 70 trailing blade 54 will continue to enlarge but no partial vacuum will exist in holes 62*a* and 62*b* because of the now effective presence of vent holes 64 which connect chamber 70 to the surrounding atmosphere. As will be seen then, while the drum 22 is rotating from its FIG. 1 position to its FIG. 6 position there will be a partial vacuum present in holes 62*a* and 62*b*. On the other hand as the drum completes its cyclic one revolution of movement in rotating from its FIG. 6 position to its FIG. 1 home position there will be substantially no such partial vacuum present in said chamber 70 and holes 62*a* and 62*b*.

Considering now the operation of the drum 22 in relation to the conventional type label applying system or environment previously described in connection with FIGS. 1 and 2, it will be unerstood that the frictional driving effect on a label disposed between the idler roll 21 and the outer peripheral surface of the drum ridges 61 will not be sufficient to feed or move the next label 73 to be applied prior to the time that said label is severed from the tape 11 by the kife 15. When the tape 11 is fed by rolls 13, 14 and 16, 17 so that the next label 73 to be operated on is its said first or the FIG. 4 position the drum rotation is initiated so that when the first or lead holes 62*a* reach the region just before the leading edge 72 of the label 73 the leading end of the latter can be drawn to and held against drum by the presence of said partial vacuum in holes 62*a*. Just prior to the label being thus drawn towards the drum surface the knife 15 is operated and the label is then free to move away from its said first or FIG. 4 position. Before the drum reaches its FIG. 5 position, the partial vacuum in trailing holes 62*b* will be operative to hold the trailing end o the label 73 against the drum whereby the label is secured to and can continue its movement with the drum periphery as indicated in FIG. 5 so as to be initially moistened on its outer surface by the operation of said moistening means 23. Of course, when the label 73 covers the holds 62*a* and 62*b* no air flow into these holes occurs, respectively, and hence the partial vacuum in chamber 70 can be readily sustained by the operation of the previously described vacuum generating means. When the drum and label reach the FIG. 6 position the leading end of the label will be lightly rolled into engagement with the upper surface of the envelope 25, or the like, that is being fed to the left at substantially the same linear speed as that of label 73. As the drum moves past its FIG. 6 position and the partial vacuum no longer exists in lead holes 62*a* and 62*b* the moistened label will be progressively separated from the drum and rolled out onto and will adhere to the evelope 25. Thereafter the drum completes its cyclic one revolution of movement, returning to its FIG. 1 home position preparatory to picking up the next label and depositing the latter on the next document to be fed passed the lower side of drum 22.

The specific arrangement and operation of the various control means for operating and timing the various system elements such as the knife 15, the label feed rolls 13, 14, 16, 17, the envelope feed rolls 26 and the drum drive belt 37 form no part of the instant invention and the discussed general presence and functioning thereof is significant only to the extent that they constitute the structural and operational environment for, and the combination with the described drum 22 and its internal vacuum generating means.

As will be clear from the above description not only is there a cyclic label-holding partial vacuum generated in response to the rotation of the drum 22, but the timing and duration of said partial vacuum are arranged so as to occur during substantially the first half revolution of the drum 22 the next label is picked up by the drum at said first position and transported to said second position where it is deposited on the document or envelope 25. No partial vacuum is present at the drum periphery during substantially the second half of the cyclic one revolution of movement of drum 22. Thus the presence and predetermined timing of said partial vacuum at the drum periphery is inherent in response to the rotation of the label applicator drum, hence in the instant arrangement no external pumps, valves, valve actuators, couplings, etc. are required for the efficient functioning of said drum and its internal vacuum generating means in cooperation with the adjacent label handling structure.

It will be apparent that this arrangement affords a very simple, low cost and durable vacuum generating means and a label applicator drum, as incorporated in a label applying machine.

What is claimed is:

1. In a label applying apparatus having a rotatable applicator drum, means for feeding a series of labels to a first position adjacent the periphery of said drum, and means for feeding a label receiving document past a second position adjacent the periphery of said drum: the improvement comprising a stationary shaft partially disposed within and rotatably supporting said drum;

vacuum generating means disposed within said drum operative in response to the rotation of said drum, including an internal cylindrical surface formed in said drum having an axis of rotation which is eccentric relative to the axis of said shaft to thereby define a chamber of variable radial distance between said drum and said shaft and radially movable blade means that slidably cooperate with the walls of said chamber; and vacuum passage means formed and communicating between said chamber and a portion of the periphery of said drum whereby a partial vacuum is generated when said peripheral drum portion is located at said first position and whereby said partial vacuum is released as said drum peripheral portion passes said second position.

2. Apparatus as defined by claim 1 wherein said drum carries an internal substantially radially movable blade that slidably contacts said shaft means.

3. Apparatus as defined by claim 2 wherein said shaft means has mounted thereon a substantially radially movable sealing blade that cooperates with said internal cylindrical surface formed in said drum.

* * * * *